US009085832B2

(12) United States Patent
Mellier et al.

(10) Patent No.: US 9,085,832 B2
(45) Date of Patent: Jul. 21, 2015

(54) STRAND, STRUCTURAL CABLE AND METHOD FOR MANUFACTURING THE STRAND

(75) Inventors: Erik Mellier, Versailles (FR); Stéphane Joye, Boulogne-Bollancourt (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 171 days.

(21) Appl. No.: 13/814,211

(22) PCT Filed: Aug. 3, 2010

(86) PCT No.: PCT/FR2010/051646

§ 371 (c)(1), (2), (4) Date: Mar. 1, 2013

(87) PCT Pub. No.: WO2012/017135

PCT Pub. Date: Feb. 9, 2012

(65) Prior Publication Data

US 2013/0174530 A1 Jul. 11, 2013

(51) Int. Cl.

| | |
|---|---|
| ***D02G 3/36*** | (2006.01) |
| ***D07B 1/16*** | (2006.01) |
| ***D07B 5/00*** | (2006.01) |
| ***E01D 19/16*** | (2006.01) |
| ***E04C 5/08*** | (2006.01) |
| *D07B 1/14* | (2006.01) |

(52) U.S. Cl.

CPC *D02G 3/36* (2013.01); *D07B 1/162* (2013.01); *D07B 5/00* (2013.01); *E01D 19/16* (2013.01); *E04C 5/085* (2013.01); *D07B 1/144* (2013.01); *D07B 2201/2044* (2013.01); *D07B 2201/2046* (2013.01); *D07B 2201/2077* (2013.01); *D07B 2201/2088* (2013.01); *D07B 2205/201* (2013.01); *D07B 2205/2046* (2013.01); *D07B 2205/502* (2013.01); *D07B 2205/505* (2013.01); *D07B 2205/507* (2013.01); *D07B 2401/205* (2013.01); *D07B 2501/203* (2013.01)

(58) Field of Classification Search

CPC ..... E01D 19/02; E01D 22/00; E04C 5/08; B29C 61/02; D07B 1/16

USPC ..... 57/232, 258; 427/175

See application file for complete search history.

(56) References Cited

U.S. PATENT DOCUMENTS

| | | | | |
|---|---|---|---|---|
| 5,327,714 | A * | 7/1994 | Stevens et al. | 57/230 |
| 5,829,242 | A * | 11/1998 | Berglund | 57/295 |
| 6,692,829 | B2 * | 2/2004 | Stubler et al. | 428/379 |
| 2011/0259677 | A1 * | 10/2011 | Dudde et al. | 187/411 |
| 2014/0065913 | A1 * | 3/2014 | Klein et al. | 442/333 |

FOREIGN PATENT DOCUMENTS

| | | |
|---|---|---|
| DE | 38 31 069 | 3/1990 |
| DE | 44 35 744 | 4/1996 |
| DE | 295 00 560 | 5/1996 |

(Continued)

*Primary Examiner* — Shaun R Hurley

(74) *Attorney, Agent, or Firm* — McKenna Long & Aldridge LLP

(57) ABSTRACT

A strand (3) comprising a group of twisted threads (8) and arranged so as to have, over a first part (1) of its length: a sheath (4) containing the group of twisted threads, and a flexible filling product (7) filling a peripheral interstice (6) located between the inner face of the sheath and the periphery of the group of twisted threads, and, over a second part (2) of its length, which is separate from the first part: a material (9) covering the periphery of the group of twisted threads, said material adhering to the twisted threads of the group.

12 Claims, 3 Drawing Sheets

(56) References Cited

FOREIGN PATENT DOCUMENTS

| | | |
|---|---|---|
| EP | 0855471 | 7/1998 |
| EP | 0 950 762 | 10/1999 |
| EP | 1211350 | 6/2002 |
| JP | 2005-048405 | 2/2005 |

* cited by examiner

STRAND, STRUCTURAL CABLE AND METHOD FOR MANUFACTURING THE STRAND

This Application is a 35 U.S.C. §371 National Stage Entry of International Application No. PCT/FR2010/051646, filed Aug. 3, 2010, which is incorporated by reference in its entirety herein.

BACKGROUND OF THE INVENTION

The invention relates to strands used in civil engineering structures or other structures.

Individually protected strands comprising multiple twisted metal wires (also referred to as threads) are known; commonly there are six steel wires forming a helix around a central steel wire. The metal wires frequently have undergone electrochemical treatment (galvanization, galvanization, etc.). They are also enclosed in an external sheath, generally of plastic. The space between the twisted metal wires and the sheath is filled with protective material.

These individually protected strands are conventionally used to create bridge stays, and have been found to be effective in protecting these stays against corrosion.

The protective material used in these individually protected strands generally consists of wax, for example petroleum wax, or grease. These individually protected strands therefore cannot efficiently transmit significant axial (i.e. tangential) stresses from their external sheath to their twisted metal wires.

This is why such individually protected strands cannot be used in applications where axial forces, likely to cause the sheath to slide on the metal wires, must be applied to the strands. Such is the case for suspension bridges or other suspended structures, as well as bridges with saddles. In a suspension bridge for example, main cables comprising bundles of individually protected strands must withstand frictional stresses exerted parallel to their axis, and these stresses are for example transmitted by clamping collars from which the deck of the bridge is suspended by means of hangers.

One solution is to remove the sheath from the strands and use direct attachment to the metal wires. However, this lessens the corrosion protection and therefore the durability of the structure of which the strands are a part.

"Cohesive" strands are also known. Compared to the sheathed-greased strands or sheathed-waxed strands mentioned above, the filling product used in cohesive strands, between the twisted metal wires and the sheath, is a protective material that adheres to the metal wires and to the inner surface of the sheath, typically an adhering polymer.

Cohesive strands are therefore particularly useful when it is necessary to transfer axial (i.e. tangential) stresses from the sheath to the metal wires, for example in the main cables of suspension bridges, in bridges with saddles, or other applications.

Details on cohesive strands can be found in EP 0 855 471 for example.

One disadvantage of cohesive strands lies in their manufacturing cost, while their adhesion properties are potentially only used within a very small portion of their length: the cumulative lengths of the collars in the case of a suspension bridge, the length of the saddle in the case of a bridge with saddles, etc., which can represent less than 10% of the total cable length.

In addition, it is technically complex to obtain satisfactory cohesiveness on an interface of protective material/plastic material (e.g. HDPE). This complexity is further increased when the interface in question is extensive. Such cohesiveness for the entire length of a strand can be difficult to obtain other than in the factory during manufacture of the strand and under carefully controlled conditions.

An object of the invention is to propose a strand which reduces at least some of the above disadvantages.

SUMMARY OF THE INVENTION

The invention therefore proposes a strand comprising a group of twisted wires. This strand is arranged to comprise:

- over a first part of its length: a sheath containing the group of twisted wires, and a flexible filling product that fills a peripheral void located between the inner face of the sheath and the periphery of the group of twisted wires, and
- over a second part of its length, which is distinct from the first part: a material covering the periphery of the group of twisted wires, said material adhering to the twisted wires of the group.

Due to its composition, such a strand is well protected, particularly against corrosion, and there is no risk of it being damaged by the sheath sliding on the twisted wires. Its cohesiveness is limited to only a portion of the length of the strand, which simplifies its implementation.

In advantageous embodiments which can be combined in any conceivable manner:

said second part corresponds to a total length which is less than the total length of said first part; thus the cohesiveness of the strand is limited to what is strictly necessary;

said second part corresponds to a set of locations distributed along the length of the strand and each intended to cooperate with a structural element likely to locally generate axial stresses on the strand; cohesiveness is thus ensured at the places where it is needed to transmit the axial stresses exerted on the strand;

the strand further comprises, on said second part of its length, a protective element placed in contact with said material covering the periphery of the group of twisted wires, said protective element being of the same physico-chemical nature as the sheath and forming with the sheath a protective barrier having an outer face that is substantially continuous along the entire length of the strand; the protection is thus reinforced for the entire length of the strand;

the material covering the periphery of the group of twisted wires on said second part is arranged to form, with the sheath containing the group of twisted wires, a protective barrier having an outer face that is substantially continuous along the entire length of the strand; the protection is thus reinforced along the entire length of the strand;

the flexible filling product additionally fills in at least a portion of the voids located between the twisted wires of the group substantially in the first part and the second part of the length of the strand; the protection against corrosion is thus ensured between the twisted wires;

the material covering the periphery of the group of twisted wires along a second part of its length comprises a polymer; and/or the material covering the periphery of the group of twisted wires along a second part of its length is polybutadiene.

The invention also proposes a structural cable comprising a bundle of strands as mentioned above. This cable is arranged so that said second parts of the strands of the bundle are substantially aligned for at least the majority of the strands of the bundle.

In this manner the cable offers a cohesiveness of the assembly at the relevant locations only.

The invention further proposes a method for manufacturing a strand as mentioned above, said strand including a group of twisted wires and initially comprising, along substantially its entire length, a sheath containing the group of twisted wires and a flexible filling product that fills in a peripheral void located between the inner face of the sheath and the periphery of the group of twisted wires. This method comprises the following steps relative to a second part of the length of the strand, distinct from a first part of the length of the strand which is left unchanged:

locally removing the sheath and at least a portion of the flexible filling product present at the periphery of the group of twisted wires, and covering the periphery of the group of twisted wires with a material adhering to the twisted wires of the group.

Said material can be deposited on the periphery of the group of twisted wires by extrusion, molding, or other means.

BRIEF DESCRIPTION OF THE DRAWINGS

Other features and advantages of the invention will be apparent from the following description of some non-limiting example embodiments, with reference to the attached drawings in which.

DESCRIPTION OF EMBODIMENTS

Figure 1:
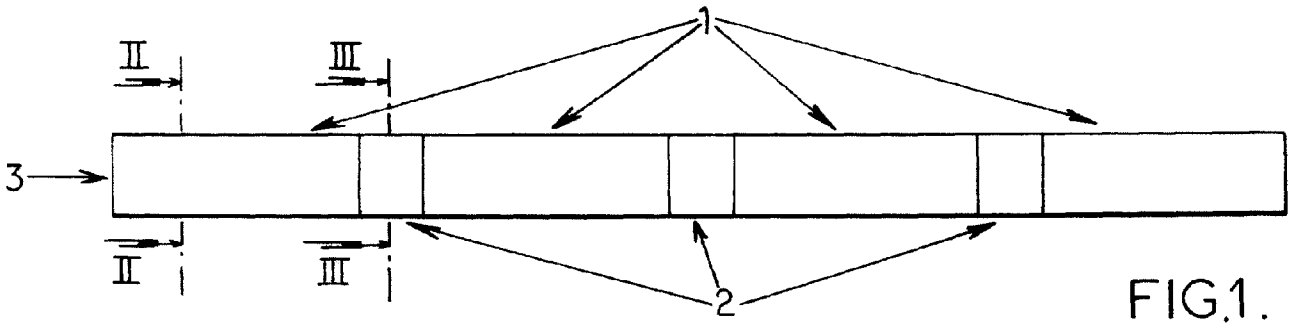
FIG. 1 is a longitudinal schematic view of a strand according to an exemplary embodiment of the invention.

The strand 3 of FIG. 1 is arranged to comprise two distinct parts, 1 and 2, along its length. In the example illustrated, these two parts each consist of sub-parts, so that they appear to alternate. In other examples, part 1 and/or part 2 of the strand 3 could be continuous, meaning one is not interrupted by the other. For example, part 2 could consist of one or both ends of the strand 3, and part 1 could represent the intermediate length of this strand 3. Any other configuration is also possible.

In the example in FIG. 1, one can see that part 2 corresponds to a total (i.e. cumulative) length that is less than that of part 1. This is well-suited for certain applications where cohesiveness in the strand is only necessary in limited portions of the strand. Part 2 could, however, be longer than or the same length as part 1 in other cases.

Advantageously, part 2 corresponds to a set of locations distributed along the length of the strand 3 and each intended to cooperate with a structural element likely to generate local axial stresses on the strand, as will be described below. However, in one variant it is possible to adopt a more random arrangement of parts 1 and 2 of the strand.

The strand 3 comprises a group of twisted wires 8, similarly to the prior art strands mentioned in the introduction. The twisted wires are typically of metal, for example steel, and have possibly undergone electrochemical treatment (galvanization, galvanization, etc.). They extend for the entire length or more or less the entire length of the strand 3, meaning through both parts 1 and 2 alike.

Figure 2:
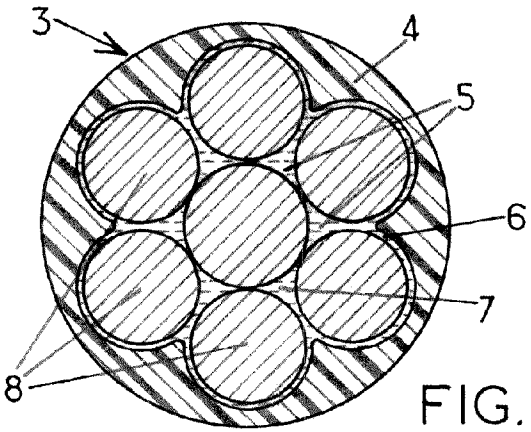
FIG. 2 is a schematic view of a transverse cross-section along axis II-II of the strand of FIG. 1.

A transverse cross-section of the strand 3 in its part 1 is represented in FIG. 2. One can see the group of twisted wires 8, which are seven in number in this example: a central wire and six peripheral wires.

A sheath 4 surrounds the group of twisted wires 8. It is for example of plastic and possibly flexible material, such as a polyolefin, particularly HDPE (high density polyethylene), or a polyamide.

A flexible filling product 7, such as an amorphous polymer, a wax, or a grease, for example from petroleum, fills a peripheral void 6 located between the inner face of the sheath 4 and the periphery of the group of twisted wires 8. In the example in FIG. 2, the flexible filling product 7 additionally fills at least part of the voids 5 located between the twisted wires 8 of the group, which are indicated in the figure as curved triangles having their sides defined by portions of the circumference of three adjacent wires.

The flexible filling product 7 advantageously has lubricating properties. In any event, it has no capacity of adhering to the twisted wires 8 (at least not to the same proportions as the material 9 described below).

Thus, in the example described here, the constitution of the strand 3 in part 1 of its length resembles that of a semi-adhesive strand as described in EP 1 211 350. This constitution may even be closer to that of the sheathed-waxed or sheathed-greased strands of the prior art, particularly in the case where the inner face of the sheath 4 does not penetrate or barely penetrates between the twisted wires 8, for example if it has a substantially circular transverse cross-section around the group of twisted wires 8.

Figure 3A:
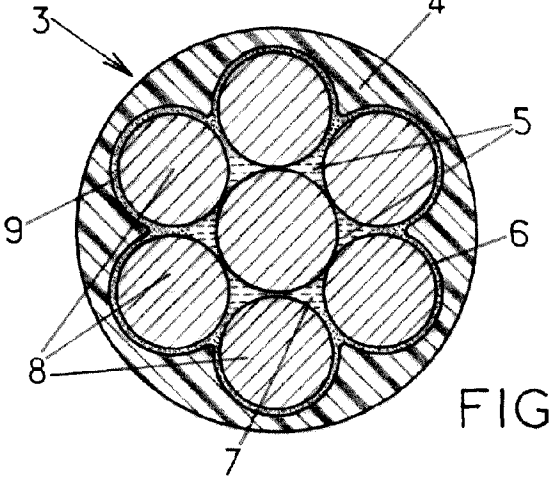
FIG. 3A is a schematic view of a transverse cross-section along axis III-Ill of the strand of FIG. 1, in a first exemplary embodiment.

An example cross-section of the strand 3 through its part 2 is represented in FIG. 3A. Most of the elements discussed with reference to FIG. 2 are again found in this FIG. 3A. One significant difference, however, is that in part 2, instead of being covered by the flexible filling product 7, the periphery of the group of twisted wires 8 is covered by a different material 9. This material 9 adheres to the twisted wires 8, by surface adhesion and/or adhesion due to surface geometries. It covers the periphery of the group of twisted wires 8, for the entire length of part 2 of the strand 3 or for only a portion of it. It is in direct contact with the twisted wires 8, although a small amount of flexible filling product 7 may be present here and there between the material 9 and the twisted wires 8 without excessively impacting the adhesion between these elements.

A protective element 4' is placed around the group of twisted wires 8, in contact with the material 9. This protective element 4' is, for example, of the same physico-chemical nature as the sheath 4 and advantageously forms with the sheath 4 a fluid-tight protective barrier having a substantially continuous outer face along the entire length of the strand. Viewed from the outside of the strand 3, when the protective element 4' is of the same physico-chemical composition as the sheath 4, it is just as if the strand 3 were equipped with a continuous sheath along its entire length (except for the seams between the sheath 4 and the protective element 4', where parts 1 and 2 of the strand connect).

The inner face of the protective element 4' can have the same form as that of the sheath 4 as illustrated in FIGS. 2 and 3A, or may have a different form, for example with greater or less penetration of the protective element between the twisted wires 8.

The material 9 advantageously adheres not only to the twisted wires 8, but also to the inner face of the protective element 4'. For this purpose, it can be made to adhere to the protective element 4', for example by a chemical bond. To do this, a bonding agent can be used such as an ethylene/acrylic ester/maleic anhydride terpolymer, a grafted polyethylene, or some other agent.

The material 9 is a polymer for example, such as an elastomer. It may be polybutadiene.

Because of the presence of this adhesive material 9, the stresses applied to the protective element 4' parallel to the axis of the strand 3 are transmitted to the twisted wires 8.

Part 2 of the strand 2 thus resembles a strand portion that is of the cohesive type as described in EP 0 855 471.

In the example in FIG. 3A, the flexible filling product 7 fills in at least a portion of the internal voids 5 located between the twisted wires 8 of the group within part 2, as it does within part 1 of the strand 3. The material 9 and the flexible filling product 7 are thus in contact with each other in proximity to the central wire of the strand 3.

Such a configuration is not required, however. The material 9 could in fact also replace the flexible filling product 7 at these voids 5, and thus fill the entire space around the twisted wires 8, delimited by the protective element 4'. In another variant, an empty space or another product could take the place of the flexible filling product 7 around the central wire of the strand 3 and out to the material 9.

Figure 3B:
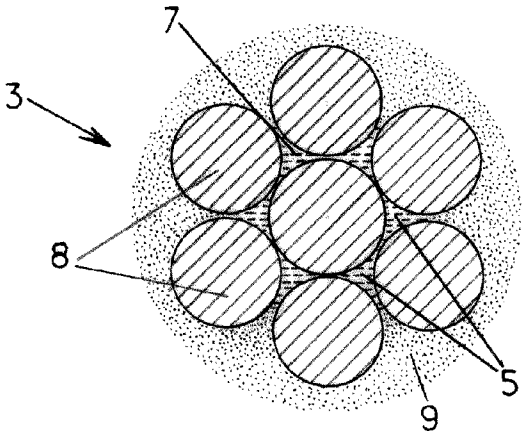
FIG. 3B is a schematic view of a transverse cross-section along axis III-Ill of the strand of FIG. 1, in a second exemplary embodiment.

FIG. 3B shows an example of a transverse cross-section of the strand 3, within its part 2, that is an alternative to the one shown in FIG. 3A.

The difference between the two arrangements is that the adhesive material 9 is not surrounded by a protective element 4' in the example in FIG. 3B. In fact, the adhesive material 9 itself fulfills a protective role for the twisted wires 8, in particular against corrosion, in addition to its role of transmitting axial stresses between the protective element 4' and the twisted wires 8.

This embodiment is well-suited for cases where the strand 3 is already externally protected from mechanical stresses, ultraviolet radiation and/or other effects, for example due to its positioning. Such is the case when part 2 of the strand 3 is located inside a saddle of a bridge, inside a cable band used in a suspension bridge, etc.

Advantageously, the material 9 forms, with the sheath 4, a fluid-tight protective barrier having a substantially continuous outer face along the entire length of the strand. For this purpose, the material 9 may have an outer face of the same shape, for example substantially circular, and of the same diameter and/or thickness as the sheath 4 used in part 1.

Similarly to the example in FIG. 3A, the flexible filling product 7 may fill in at least part of the internal voids 5 located between the twisted wires of the group, the material 9 then having an interface with the product 7. As a variant, the flexible filling product 7 could be absent, in which case the material 9, an empty space, or another product could partially or completely replace it.

One can see that the locally cohesive strands proposed by the invention profit from the advantages offered by the various prior art strands mentioned in the introduction.

In particular, they offer protection for the twisted wires along some or all of their length, as well as adhesion only in the areas where such is necessary, for example where axial stresses are likely to appear. By thus limiting the cohesiveness of the strands to only a part of their length, the manufacturing cost of the strands is reduced in comparison to cohesive strands, without sacrificing their effectiveness or durability.

The strands of the invention also allow reducing the length of the interface of adhesive material/plastic material of the sheath compared to conventional cohesive strands, which simplifies their implementation. The latter can then be done not only in the factory, but also entirely or partly on site.

Figure 4:
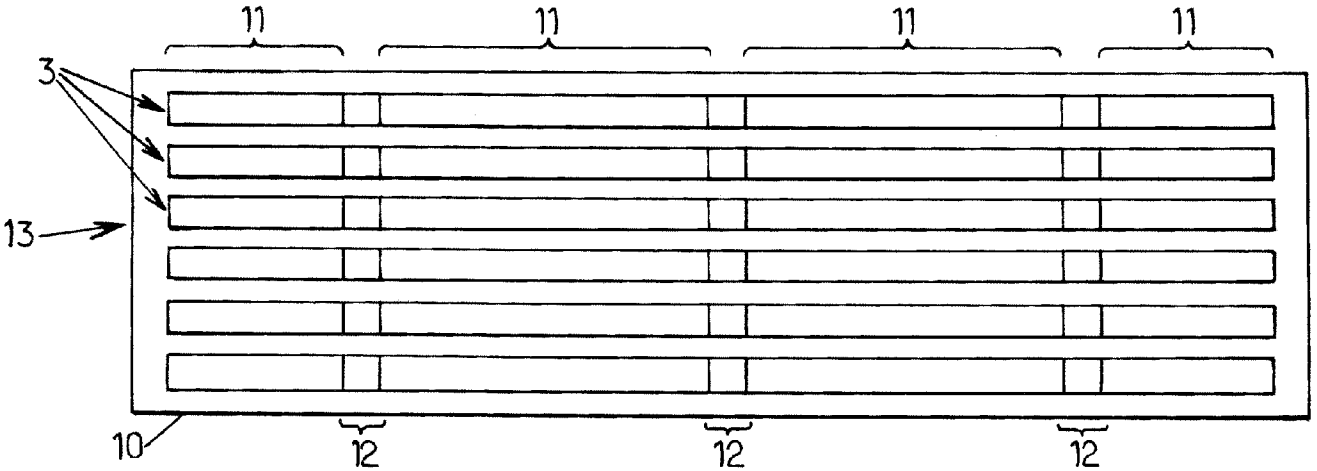
FIG. 4 is a longitudinal schematic view of an example of a structural cable which makes use of strands according to FIG. 1.

FIG. 4 shows a structural cable comprising a bundle of strands 3 identical or similar to those just described. This cable 13 can be used with any type of civil engineering structure or other structure. The bundle of strands can be organized in any possible manner, the strands 3 being for example substantially parallel to each other. It is optionally contained within a sheath 10 for all or part of the length of the cable 13.

In addition, the structural cable 13 is arranged so that part 2 (and in a corresponding manner part 1) of the strands 3 of the bundle are substantially aligned for at least the majority of said strands. This means that at least half the strands 3 of the bundle have their part 2 located approximately in the same plane, or in a plurality of planes when part 2 is divided into several sub-parts.

Reference 11 corresponds to all the parts 1 of the strands 3 and reference 12 corresponds to all the parts 2 of the strands 3. In the example in FIG. 4, the items denoted 12 show that all the strands 3 have their part 2 located approximately within one of three planes (one plane for each sub-part of part 2 of each strand 3). The planes in question are substantially orthogonal to the axis of the cable 13. Other arrangements can be envisaged to replace or supplement the one in FIG. 4.

Figure 5:
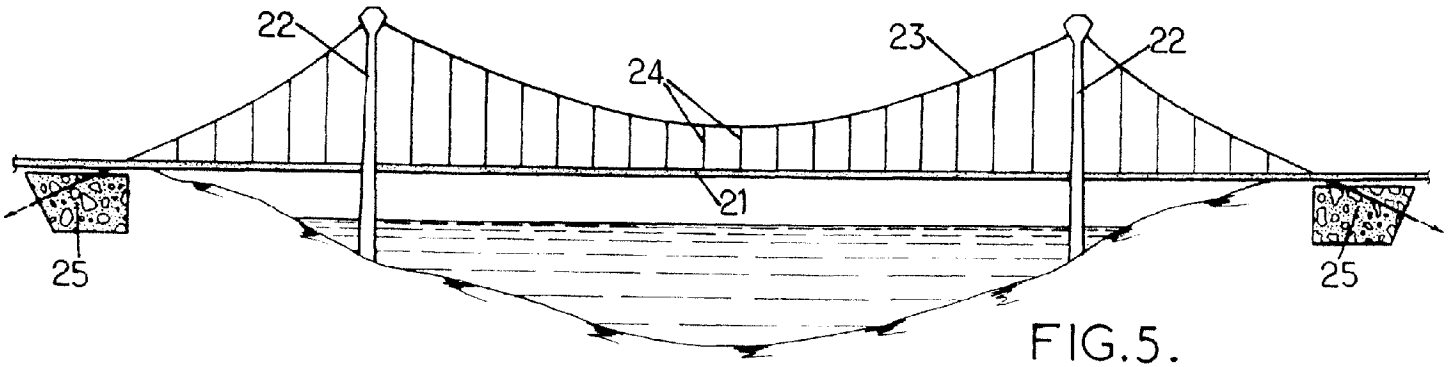
FIG. 5 is a general schematic view of an example of a suspension bridge.
Figure 6:
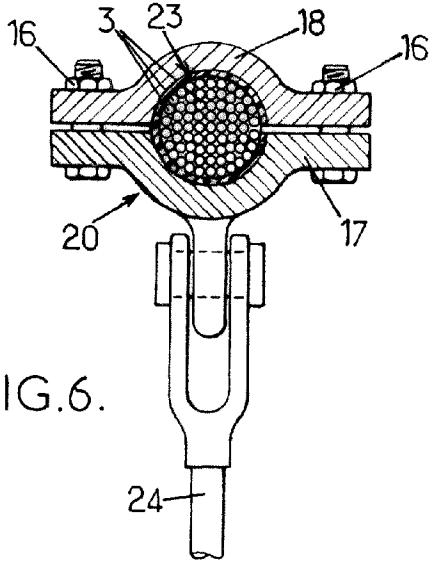
FIG. 6 is a schematic view of a transverse cross-section of a main cable of the bridge of FIG. 5, with a cable band for attaching the suspension cable.

FIGS. 5 and 6 show an example application of the strands of the invention. This non-limiting example relates to a suspension bridge.

The suspension bridge represented in FIG. 5 conventionally comprises a deck 21, two towers 22, two parallel main cables 23 of which only one is visible in the drawing, and a plurality of hangers 24 which are suspended from the main cables 23 and which support the deck 1.

In the present example, the main cables 23 are considered to be identical to the cable 13 described above in relation to FIG. 4. The numeric references used in FIG. 4 are therefore reused below relative to the main cables 23.

These main cables 23 are held taut between two anchorages in the ground 25 at the two ends of the bridge (artificial anchor blocks, anchors in the rock, or, if applicable, anchors at the two ends of the deck if this is a self-anchored suspension bridge), and they are supported by the towers 22.

As illustrated in FIG. 6, each hanger 24 may for example be suspended from one of the main cables 23 by means of a collar 20 formed of a clamp consisting of two substantially hemicylindrical metal shells 17 and 18 which are kept clamped around the cable 13 by means of bolts 16.

The main cables 23 are advantageously positioned so that their part 12 which groups all the parts 2 of the strands 3 (locally cohesive part) corresponds to the areas where the hangers 24 are suspended, at the clamping collars 20. At these locations, the hangers 24 exert downward tensile stresses on the main cables 23 which have a component tangential to the main cables 23, directed in the direction of the slope of the main cables: these are tangential (i.e. axial) stresses transmitted by friction to the sheaths 4 of the strands 3 of the main cables 23.

The local cohesiveness of the strands 3 at the clamping collars 20 allows the stresses applied parallel to the axis of the strands 3 to be appropriately transmitted to the twisted wires 8. This ensures good overall resistance.

Although the application described with reference to FIGS. 5 and 6 concerns a suspension bridge, other applications can be envisaged, as will be apparent to a person skilled in the art. In these applications, the part 2 of one or more strands 3 can advantageously correspond to a set of locations distributed along the length of the strand or strands, each one intended to cooperate with a structural element likely to generate local axial stresses on the strand or strands. This structural element is not necessarily a hanger or collar as mentioned above. It can assume various forms, depending on the chosen application.

The manufacture of a strand of the invention can be done according to any appropriate method.

In an advantageous manufacturing method, the strand 3 is first created with the sheath 4 containing the group of twisted wires 8 and the flexible filling product 7 filling the peripheral void 6 between the inner face of the sheath 4 and the periphery of the group of twisted wires 8, along substantially its entire length. At this stage in the manufacture, the strand 3 is therefore not cohesive in any portion of its length.

Then the sheath 4 and at least a portion of the flexible filling product 7 present at the periphery of the group of twisted wires 8 is removed locally, on a portion of the length of the strand 3 which will become the part 2 mentioned above (the portion of the length of the strand 3 which will become part 1 being left unchanged).

The local removal of the sheath 4 can, for example, be achieved by cutting it transversely, for example along a plane orthogonal to the axis of the strand 3, using a conventional cutting means appropriate for the sheath material, such as a saw, a laser, or other means. The portion of cut sheath can then be opened and separated from the portion of the group of twisted wires that it contained. The uncut portion of the sheath 4 remains in place.

The removal of the flexible filling product 7 present at the periphery of the group of twisted wires can also be done by any appropriate means. This may, for example, involve wiping the periphery of the group manually by an operator, by a machine, by a combination of the two, or some other manner. This wiping can be more or less thorough, depending on whether a small amount of flexible filling product 7 remaining at some points on the surface of the twisted wires 8 can be tolerated.

Where the sheath 4 was removed, the group of twisted wires 8 is then covered with the adhesive material 9 mentioned above.

The placement of the adhesive material 9 on the periphery of the group of twisted wires 8 can be done by extrusion for example. For this purpose, the uncovered part of the strand 3 can be placed in an extruder which deposits the adhesive material 9. This extrusion is for example of the type described in EP 0 855 471, or some other type.

As a variant, the placement of the adhesive material 9 on the periphery of the group of twisted wires 8 can be done by molding for example.

When the strand 3 is to have its part 2 surrounded by a protective element 4' placed in contact with the adhesive material 9, this protective element 4' can be put in place in any imaginable manner. It can, for example, be deposited by hot extrusion so that the adhesive material 9 is coated, by molding, or by another manner.

It is possible to coat the material 9 with a binding agent as mentioned above, for example by coextrusion, before the protective element 4' is put in place, in order to adhere the material 9 to the material constituting the protective element 4'.

A person skilled in the art will understand that other methods for manufacturing a locally cohesive strand can be used in the context of the invention. In particular, the strand 3 can be manufactured without the flexible filling product 7 and the sheath 4 initially extending along its entire length. In this case, parts 1 and 2 could appear substantially simultaneously during the manufacture of the strand 3.

Other variants can be envisaged in the context of the invention, as will be apparent to a person skilled in the art.

What is claimed is:

1. A strand comprising a group of twisted wires, said strand comprising:

over a first part of a length of said strand: a sheath that contains the group of twisted wires, and a flexible filling product that fills a peripheral void located between an inner face of the sheath and a periphery of the group of twisted wires, and over a second part of the length of said strand, the second part being distinct from the first part: a material covering the periphery of the group of twisted wires, said material adhering to the twisted wires of the group, the sheath being interrupted between the first and second parts.

2. The strand of claim 1, wherein said second part corresponds to a total length which is less than a total length of said first part.

3. The strand of claim 1, wherein said second part corresponds to a set of locations distributed along the length of the strand and each configured to cooperate with a structural element arranged to locally generate axial stresses on the strand.

4. The strand of claim 1, further comprising, on said second part of the length of the strand, a protective element placed in contact with said material covering the periphery of the group of twisted wires, said protective element having a same physico-chemical nature as the sheath and forming with the sheath a protective barrier having an outer face that is substantially continuous along the entire length of the strand.

5. The strand of claim 1, wherein the material covering the periphery of the group of twisted wires on said second part is arranged to form, with the sheath containing the group of twisted wires, a protective barrier having an outer face that is substantially continuous along the entire length of the strand.

6. The strand of claim 1, wherein the flexible filling product additionally fills in at least a portion of voids located between the twisted wires of the group substantially in the first part and the second part of the length of the strand.

7. The strand of claim 1, wherein the material covering the periphery of the group of twisted wires along the second part of the length of the strand comprises a polymer.

8. The strand of claim 7, wherein the material covering the periphery of the group of twisted wires along the second part of the length of the strand is polybutadiene.

9. A structural cable comprising:

a bundle of strands, wherein each strand comprises a respective group of twisted wires, comprising:

over a first part of a length of said strand: a respective sheath that does not extend beyond said first part and that contains said group of twisted wires, and a flexible filling product that fills a peripheral void located between an inner face of said sheath and a periphery of said group of twisted wires, and over a second part of the length of said strand, the second part being distinct from the first part: a material covering the periphery of the group of twisted wires, said material adhering to the twisted wires of the group; and wherein the bundle of strands is arranged so that said second parts of the strands of the bundle are substantially aligned with each other for at least a majority of the strands of the bundle.

10. A method of manufacturing a strand, wherein said strand includes a group of twisted wires and initially comprises, over substantially an entire length of said strand, a sheath containing the group of twisted wires and a flexible filling product that fills in a peripheral void located between an inner face of the sheath and a periphery of the group of twisted wires, said method comprising:

leaving a first part of the length of the strand unchanged, locally removing the sheath and at least a portion of the flexible filing product present at the periphery of the group of twisted wires in a second part of the length of the strand, distinct from the first part, and covering the periphery of the group of twisted wires, in the second part of the length of the strand, with a material adhering to the twisted wires of the group.

11. The method of claim 10, wherein said material is deposited on the periphery of the group of twisted wires by extrusion.

12. The method of claim 10, wherein said material is deposited on the periphery of the group of twisted wires by molding.

* * * * *